US005724645A

United States Patent [19]

Na

[11] Patent Number: 5,724,645

[45] Date of Patent: Mar. 3, 1998

[54] CIRCUIT FOR CONTROLLING A RADIO-FREQUENCY OUTPUT VOLTAGE LEVEL AND IDENTIFYING THE CONTINUITY OF AN INTER FACILITY LINK CABLE USING A LOW FREQUENCY SIGNAL, AND METHOD THEREOF

[75] Inventor: Kweon Na, Seoul, Rep. of Korea

[73] Assignee: Hyundai Electronics Industries Co., Ltd., Kyoungki-do, Rep. of Korea

[21] Appl. No.: 513,540

[22] Filed: Aug. 10, 1995

[30] Foreign Application Priority Data

Dec. 31, 1994 [KR] Rep. of Korea ..... 94-40388

[51] Int. Cl.[6] ..... H04H 1/00

[52] U.S. Cl. ..... 455/3.2; 455/9; 455/67.1; 455/127

[58] Field of Search ..... 455/3.2, 9, 67.1, 455/67.7, 127, 14, 24, 67.4, 68, 69, 70, 234.1, 235.1

[56] References Cited

U.S. PATENT DOCUMENTS 5,386,587 1/1995 Yuzawa ..... 455/3.2
5,432,501 7/1995 Yoon ..... 455/3.2

FOREIGN PATENT DOCUMENTS 3-101526 4/1991 Japan .

*Primary Examiner*—Nguyen T. Vo
*Attorney, Agent, or Firm*—Merchant, Gould, Smith, Edell, Welter & Schmidt

[57] ABSTRACT

In a circuit for controlling an RF output voltage level and identifying the continuity of an IFL cable using a low frequency signal, the low frequency signal is transmitted to an outdoor unit after being level-controlled in an indoor unit. The level of an intermediate frequency transmission (IF TX) signal input to a transmit block up-converter (TBU) is controlled using the low frequency signal so that the RF output voltage level output from a solid state power amplifier (SSPA) is finally controlled. The low frequency signal is transmitted back from the outdoor unit to the indoor unit, and the indoor equipment detects the signal, thereby identifying the presence or absence of an abnormal connection of an IFL cable. An EIRP adjustment circuit is simplified without a microcomputer and its pheripheral circuits, by using a low-frequency signal which is not damaged by a communication cable. Also, the attenuation of the IF TX signal due to the communication cable is automatically compensated. Since the presence or absence of the abnormal connection of the IFL cable can be easily identified indoors using a visual signal, it is possible to detect abnormal components quickly at the time of when the problem occurs in the system, thereby saving the time for repairing the malfunction.

8 Claims, 3 Drawing Sheets

CIRCUIT FOR CONTROLLING A RADIO-FREQUENCY OUTPUT VOLTAGE LEVEL AND IDENTIFYING THE CONTINUITY OF AN INTER FACILITY LINK CABLE USING A LOW FREQUENCY SIGNAL, AND METHOD THEREOF

BACKGROUND OF THE INVENTION

1. Field of the Invention

The present invention relates to a circuit for controlling a radio-frequency (RF) output voltage level using a circuit for controlling an RF output voltage level and identifying the continuity of an inter facility link (IFL) using a low frequency signal, and the method thereof 2. Background of the Invention Generally, in a communication system using satellite communication equipment, it is essential to adjust equivalent isotropic radiated power (EIRP). Conventionally, for the purpose of the EIRP adjustment, an RF output voltage level is controlled, which uses a microcomputer and its peripheral circuits. Thus, the circuit becomes complicated, thereby increasing the cost. Also, in order to identify the presence or absence of the abnormal connection of the IFL cable, the IFL cable should be separated from the system for executing a test.

Meanwhile, a technique for communicating with a satellite from a satellite local station is known by the Japanese patent laid-open publication number 3-101526, which relates to a technique for facilitating the operation of satellite circuits by monitoring the state of the satellite circuits of the communicating parties in the satellite communication ground station without control means for keeping satellite outputs constant. Particularly, this technique is accomplished by further installing logic means for calculating reduced amount of down-link from a satellite toward one party with a received level obtained by receiving a communicating signal transmitted from the party, or for calculating a reduced amount of up-link toward the other party with a received level obtained by receiving a communication signal transmitted from the other party the reduced amount of the down-link of the party, thereby monitoring the state of satellite circuits of the communicating parties in the satellite communication ground station without control means for keeping satellite outputs constant, so that the operation of satellite circuits is facilitated.

That is to say, the technique aims at easily finding the errors of communication signals by calcuating the reduced amount of the down-link of the party and that of the up-link of the other party, and facilitating the operation of satellite circuit by monitoring the state of the satellite circuit. However, this cannot be adopted for the case when it is intended to detect abnormal parts quickly at the time when the abnormality of a system occurs in such a manner that the attenuation of an IF signal by a TX cable is automatically compensated, and that the abnormal connection of the IFL installed between indoor equipment and outdoor equipment is easily identified indoors by sight using a light emission diode (LED).

SUMMARY OF THE INVENTION

To solve the problems of the prior art, in the present invention, a reference level is detected from a low-frequency signal which is level-controlled into one of 256 steps using the characteristic that the low-frequency signal is scarcely attenuated, and a low-frequency signal which is level-controlled by multiplexing an IF signal, transmitting the same from indoor equipment to outdoor equipment via a TX cable, and separating these signals in the outdoor equipment. The gain of a variable gain amplifier (VGA) is adjusted as much as the reference level, the level of the IF TX signal input to the TBU is controlled, and the RF output voltage level output from the solid state power amplifier is finally controlled.

Also, in the present invention, there is provided means wherein if the low-frequency signal separated from the outdoor equipment is multiplexed with an IF RX signal to then transmit to the outdoor equipment via a (reception) RX cable, the level of the low-frequency signal is detected by the low-frequency detector, thereby turning on a green LED so that the abnormal connection of IFL cable can be identified easily by sight.

A circuit for controlling an RF output voltage level for the adjustment of an equivalent isotropic radiated power (EIRP) of a satellite communication system in one embodiment includes: an indoor equipment having a modulator for modulating an input signal, a low-frequency oscillator for oscillating and outputting a low-frequency signal, a low-frequency variable gain amplifier for controlling the voltage gain of the low-frequency oscillated signal output from the low-frequency variable gain amplifier, a transmitting party multiplexer (TX MUX) for multiplexing and outputting a signal input from the modulator and low-frequency variable gain amplifier, a base band & control board (BB&C) for outputting an RF output voltage level control signal and a latch control signal, a latch for storing the RF voltage level control output from the BB&C in accordance with the latch control signal, a digital-to-analog (D/A) converter for converting a digital signal input from the latch into an analog signal and outputting the converted signal as a control voltage of the low-frequency variable gain amplifier, a receiving party demultiplexer (RX-DEMUX) for separating a loop-back low frequency signal and intermediate-frequency reception (IF RX) signal among signals multiplexed and input from the receiving party multiplexer, a receiver for receiving the IF RX signal separated from the receiving party demultiplexer, a low-frequency detector for detecting the level of the loop-back low frequency signal output from the receiving party demultiplexer, and a light emission diode driven by the signal output from the low-frequency detector; and an outdoor equipment having a transmitting party demultiplexer (TX-DEMUX) for receiving the signal output from the transmitting party multiplexer of the indoor equipment and separating a low-frequency signal and an intermediate-frequency transmission (IF TX) signal, an RF output voltage level controller for controlling the RF output voltage level of the IF TX signal separated from the transmitting party demultiplexer, a transmit block up-converter (TBU) for up-converting an intermediate frequency into a radio frequency in accordance with the signal output from the RF output voltage level controller, a solid state power amplifier (SSPA) for amplifying the RF output signal output from the TBU, an antenna for transmitting and receiving signals, an antenna coupler for controlling the TX/RX path of the signal transmitted via the antenna, a low noise amplifier for low-noise amplifying received data under the control of the antenna coupler, and a receiving party multiplexer (RX-MUX) for multiplexing the low-frequency signal output from the transmitting party demultiplexer and the IF RX signal output from the low noise amplifier and outputting to the receiving party demultiplexer.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE INVENTION

Figure 1:
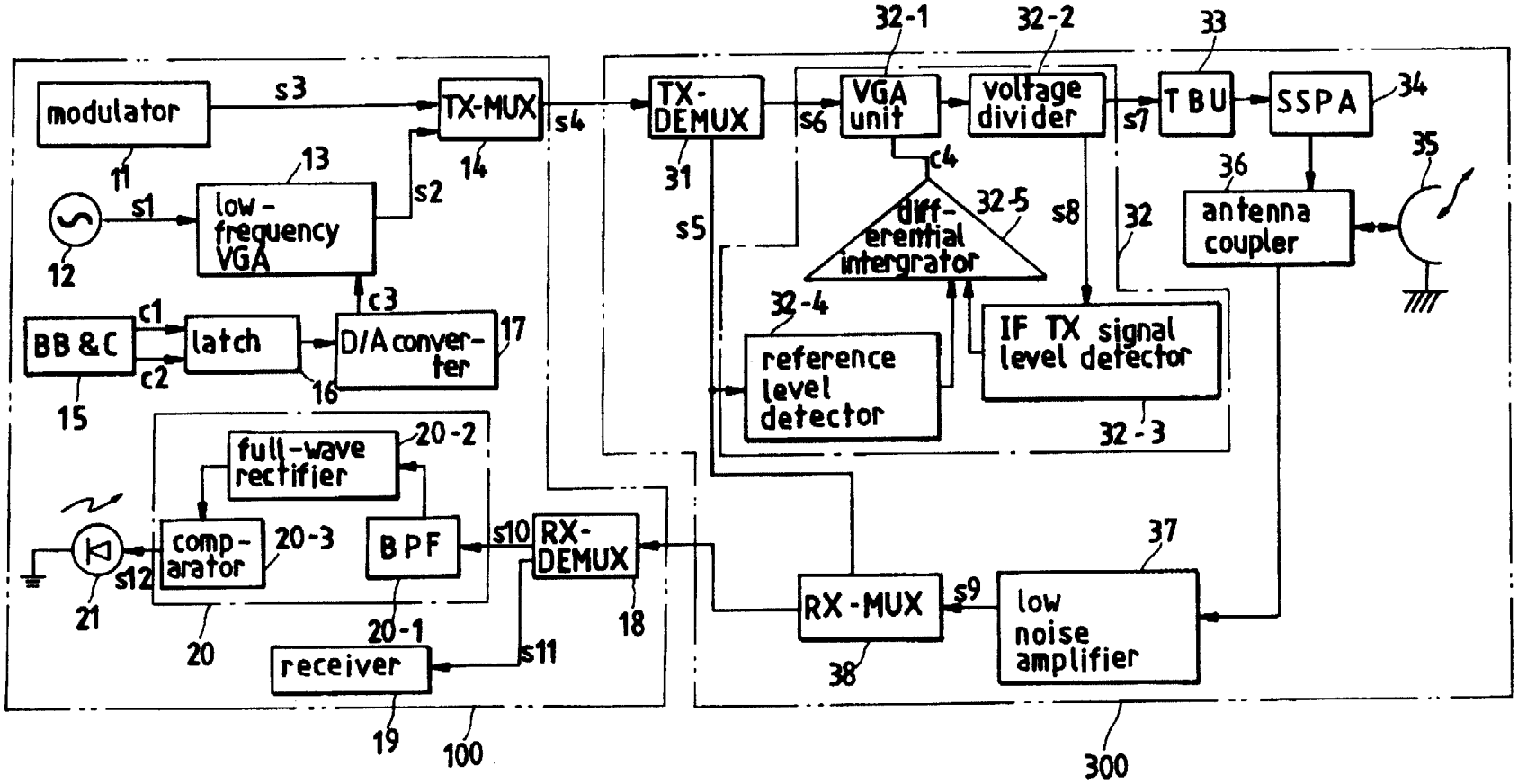
FIG. 1 is an overall block diagram of the present invention.

As shown in FIG. 1 which is an overall block diagram showing a circuit for controlling an RF output voltage level and identifying the continuity of an inter facility link (IFL) cable implemented by the present invention, the circuit includes an indoor unit 100 having a modulator 11 for modulating an input signal, a low-frequency oscillator 12 for oscillating and outputting a low-frequency signal, a low-frequency variable gain amplifier 13 for controlling the voltage gain of the low-frequency oscillated signal output from the low-frequency oscillator 12, a transmitting party multiplexer (TX-MUX) 14 for multiplexing and outputting a signal input from the modulator 11 and the low-frequency variable gain amplifier 13, a base band & control board (BB&C) 15 for outputting an RF output voltage level control signal C1 and a latch control signal C2, a latch 16 for storing the RF voltage level control output from the BB&C 15 in accordance with the latch control signal C2. A digital-to-analog (D/A) converter 17 converts a digital signal input from the latch 16 into an analog signal and outputs the converted signal as a control voltage C3 of the low-frequency variable gain amplifier 13. A receiving party demultiplexer (RX-DEMUX) 18 separates a loop-back low frequency signal and an intermediate frequency receive (IF RX) signal from signals multiplexed and input from a receiving party multiplexer (RX-MUX) 38. A receiver 19 receives the IF RX S11 separated from the receiving party demultiplexer 18. A low-frequency detector 20 detects the level of the loop-back low frequency signal S10 output from the receiving party demultiplexer 18, and a light emitting diode (LED) 21 is driven by the signal S12 output from the low-frequency detector 20 in response to the detracted low frequency signal. An outdoor unit 300 includes a transmitting party demultiplexer (TX-DEMUX) 31 for receiving the signal output from the transmitting party multiplexer 14 of the indoor unit 100 and separating a low-frequency signal S5 and an intermediate-frequency transmission (IF TX) signal S6. An output voltage level controller 32 controls the RF output voltage level of the IF TX signal S6. A transmit block up-converter (TBU) 33 up-converts the IF signal into an RF signal in accordance with the signal S7 output from the RF output voltage level controller 32. An amplifier 34, preferably a solid state power amplifier (SSPA), amplifies the RF output signal output from the TBU 33. An antenna 35 transmits and receives satellite signals. An antenna coupler 36 controls the TX/RX path of the signal transmitted from the antenna 35. A low noise amplifier 37 amplifies the signal received by the antenna under the control of the antenna coupler 36. The receiving party multiplexer (RX-MUX) 38 multiplexes the low-frequency signal output from the transmitting party demultiplexer 31 and the IF RX signal output from the low noise amplifier 37, to transmit a multiplexed output to the receiving party demultiplexer 18.

Figure 2:
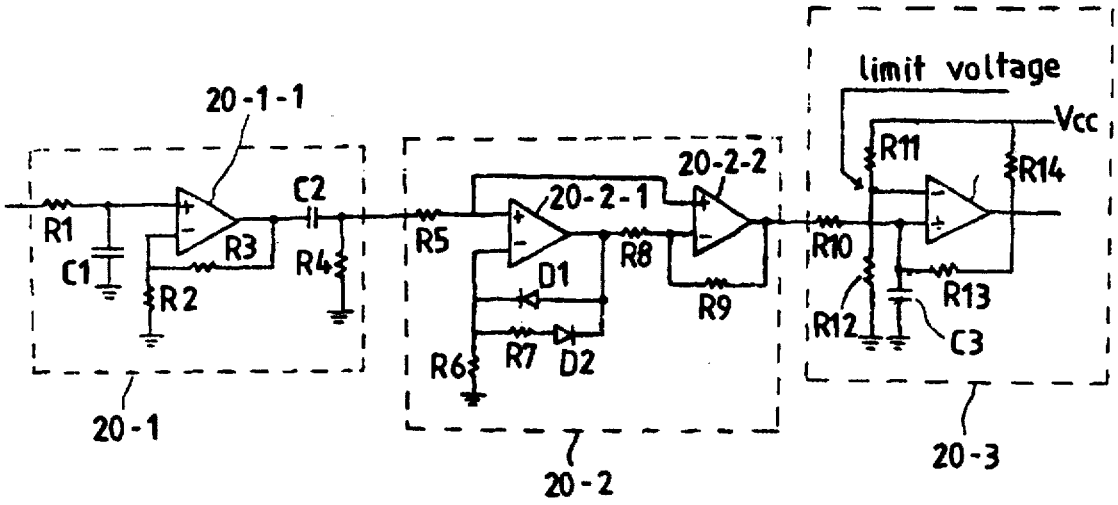
FIG. 2 is a detailed block diagram of a low-frequency detector shown in FIG. 1.

The configuration of the low-frequency detector 20 of the indoor unit 100 is described in detail with reference to FIG. 2.

The low-frequency detector 20 includes a bandpass filter 20-1 having resistors R1 to R4, capacitors C1 and C2 and an operational amplifier 20-1-1 for receiving the loop-back low frequency signal S10 output from the receiving party demultiplexer 18. The bandpass filter 20-1 filters specific bands ranging from a first predetermined frequency $f_1$ to a second predetermined frequency $f_2$. A full-wave rectifier 20-2 having resistors R5 to R9, diodes D1 and D2, and respective operational amplifiers 20-2-1 and 20-2-2 detects the level of the signal from the bandpass filter 20-1. A comparator 20-3, having resistors R10 to R14, a capacitor C3 and an operational amplifier 20-3-1 compares a limit voltage with the voltage of the signal input via the full-wave rectifier 20-2 and outputs a result value to the LED 21.

Figure 3:
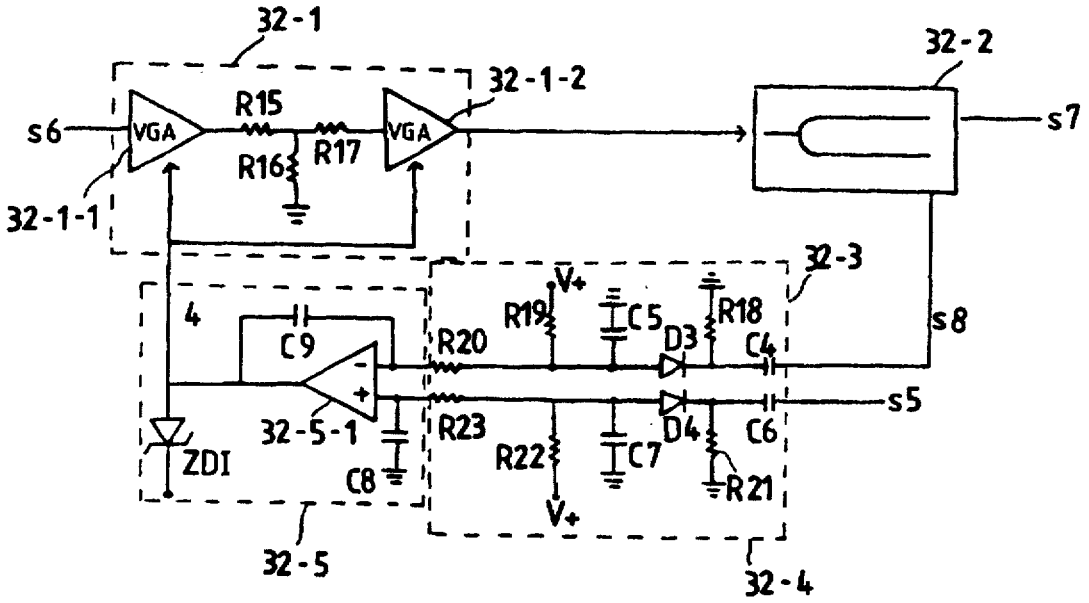
FIG. 3 is a detailed block diagram of a radio-frequency output voltage level controller shown in FIG. 1.

The configuration of the RF output voltage level controller 32 of the outdoor unit 300 is described in detail with reference to FIG. 3.

The RF output voltage level controller 32 includes a variable gain amplifying unit 32-1 having resistors R15 to R17 and respective variable gain amplifiers 32-1-1 and 32-1-2 for adjusting the voltage level of the IF TX signal. A voltage divider 32-2 divides the voltage of the IF TX signal output from the variable gain amplifying unit 32-1 and outputs the divided voltages to an IF TX signal level detector 32-3 via output S8 and to TBU via output S7. An IF TX signal level detector 32-3 having resistors R18 to R20, capacitors C4 and C5 and a diode D3, detects the level of the signal output from the voltage divider 32-2 and inputs the resultant value to a differential integrater 32-5. A reference level detector 32-4 having resistors R21 to R23, capacitors C6 and C7 and a diode D4, detects the reference level of the low-frequency signal output from the transmitting party demultiplexer 31 and inputs the result value to the the differential integrater 32-5. The differential integrater 32-5 includes capacitors C8 and C9, a zener diode ZD1, and an operational amplifier 32-5-1, compares the signals input from the IF TX signal level detector 32-3 and reference level detector 32-4 and outputs the result to the variable gain amplifying unit 32-1.

Figure 4:
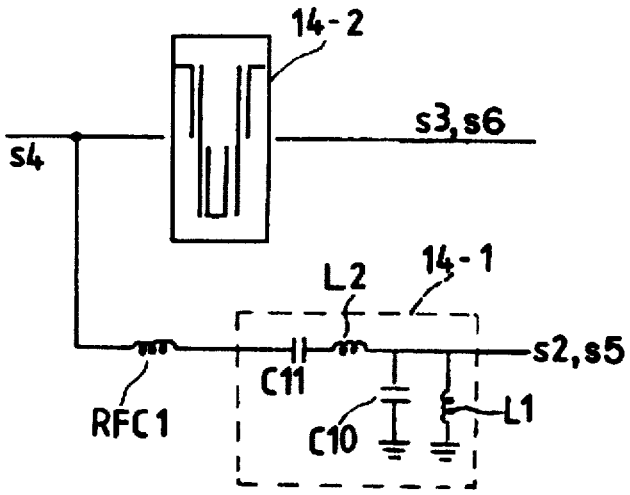
FIG. 4 is a detailed block diagram of a transmitting party multiplexer and a transmitting party demultiplexer shown in FIG. 1.

The configurations of the transmitting party multiplexer 14 and transmitting party demultiplexer 31 are similar and are described in detail with reference to FIG. 4.

Each of the transmitting party multiplexer 14 and transmitting party demultiplexer 31 includes a low-frequency bandpass filter 14-1 using coils L1 and L2, capacitors C10 and C11, and a strip bandpass filter 14-2 using an RF choke coil (RFC1) for blocking a radio frequency The transmitting party multiplexer 14 receives signals S2 and S3 as inputs and outputs signal S4. The transmitting party demultiplexer 31 receives S4 as an input and outputs signals S5 and S6.

Figure 5:
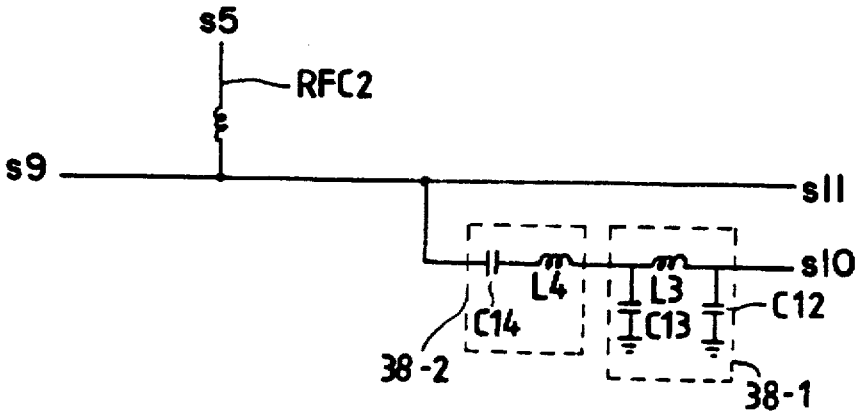
FIG. 5 is a detailed block diagram of a receiving party multiplexer and a transmitting party demultiplexer shown in FIG. 1.

The configurations of the receiving party multiplexer 38 and receiving party demultiplexer 18 are described in detail with reference to FIG. 5.

Each of the receiving party multiplexer 38 and receiving party demultiplexer 18 includes a lowpass filter 38-1 having a coil L3 and capacitors C12 and C13, a bandpass filter 38-2 having a capacitor C14 and a coil L4, and an RF choke coil (RFC2) for blocking a radio frequency.

The operation of the circuit having the aforementioned configuration according to the present invention is described.

When an RF output voltage level control signal c1 and a latch control signal c2 for controlling the RF output voltage level control signal c1 to be latched are output from the BB&C 15 to the latch 16, the latch 16 stores the RF output voltage level control signal c1 therein according to the latch control signal c2 and outputs the stored RF output voltage level control signal c1 to the D/A converter 17.

The D/A converter 17 converts the input digital signal c1 into an analog-variable-gain-amplifier-controlled voltage signal c3 and outputs the analog signal c3 to the low-frequency variable gain amplifier 13. The control voltage signal c3 is set to one voltage value out of 256 values.

At this time, a low-frequency oscillated signal s1 generated in the low-frequency oscillator 12 is input to the low-frequency variable gain amplifier 13. This signal s1 is amplified according to the variable-gain-amplifier-controlled voltage signal c3 and is converted into a low-frequency signal s2 to then be input to the transmitting party multiplexer (TX-MUX) 14, which multiplexes the signal s2 and the signal s3 modulated by the modulator 11. The TX-MUX 14 generates an output s4 to the transmitting party demultiplexer S1 of the outdoor unit 300 via a TX cable of the IFL cable. At this time, the frequency generated from the low-frequency oscillator 12 ranges from 1 KHz to 100 KHz.

The transmitting party demultiplexer 31, having received the signal S4, separates this signal s4 into a low-frequency signal s5 and IF TX signal s6 to then apply them to the respective ports as their inputs. The reference level detector 32-4, having received the low-frequency signal S5, detects the reference level of the received signal to then applies it to the differential amplifier 32-5 as one of its inputs. Since the RF output voltage level control signal from the BB&C 15 has a value ranging from step 1 to step 256, if step 128 is set as a reference step, a reference level detection signal is maximum at the step 256 so that the RF voltage becomes maximum. On the other hand, when it is the step 1, the RF voltage becomes minumum. The IF TX signal s6 is input to the voltage divider 32-2 and is divided into a transmit block up-converter input signal s7 and a level detector input signal s8 of the signal s6.

When a signal s8 is input to the IF signal level detector 32-3, the IF signal level detector 32-3 detects the level of the currently input signal s8 and then applies it to the differential integrator 32-9. The differential integrator 32-5 compares the signal input from the reference level detector 32-4 with the signal input from the signal level detector 32-3, and outputs the difference between the two signals as a control voltage signal c4 of the variable gain amplifier 32-1.

At this time, the attenuation of the IF TX signal is compared in the differential integrator 32-5 along with the signal output from the reference level detector 32-4 and is applied as the control voltage signal c4 of the variable gain amplifier 32-1, thereby automatically compensating the attenuation of the IF TX signal.

The variable gain amplifier 32-1 controls and outputs the voltage level of the IF TX signal s6 according to the input control voltage signal c4. The signal s7 finally output from the RF output voltage level controller 32 is converted into a radio frequency in the TBU 33 and is amplified in the SSPA 34 to then input to the antenna coupler 36. The antenna coupler 36 controls a reception signal so as to transmit a transmission signal and transmits the transmission signal via an antenna 35.

Meanwhile, the receiving party multiplexer 38 receives the low-frequency signal s5 separated from the transmitting party demultiplexer 31 and a signal s9 input from the low-noise amplifier 36.

The receiving party demultiplexer 18 having received the signal from the receiving party multiplexer 38, separates the signal into a loop-back low frequency signal s10, corresponding to signal S5 from the transmitting party demultiplexer 31 of the outdoor unit 300, and into an IF RX signal s11, corresponding to the input S9 from the low-noise amplifier 36. The low frequency signal s10 is applied to the low-frequency detector 20, and the IF RX signal s11 is applied to the receiver 19.

The low frequency signal s10 input to the low-frequency detector 20 is filtered through the bandpass filter 20-1 and is then level-detected through the full-wave rectifier 20-2. This signal is further input to the comparator 20-3 and is compared with the limit voltage. When thus compared signal is greater than the limit voltage, it is implied that there is no abnormality in the connection state of the IFL cable (TX/RX cable). To indicate an IFL cable normal state, the drive LED 21 is driven to output a visible signal. At this time, the blocking characteristic of the filter is not necessarily critical because of the difference between the frequencies of the IF signal and the low-frequency signal.

Also, a separate controller which has been used conventionally for controlling the RF output voltage level, is not necessary in the present invention, but multiplexers 14 and 38 and demultiplexers 31 and 18 are used. Therefore, the transmission/reception and RF output voltage levels can be controlled with a single TX cable.

In such a manner as described above, according to the present invention, an RF output voltage level of a SSPA is controlled by controlling the level of the IF TX signal input to a TBU using the low-frequency signal level-controlled and transmitted from an indoor unit. The attenuation of the IF TX signal generated in the TX cable which is a signal transmission path from the indoor unit to the outdoor unit, is compensated. The low-frequency signal transmitted from the indoor unit is fed back from the outdoor unit to the indoor unit via the RX cable, to then detected. Thus, the presence or absence of an abnormal connection of an IFL cable can be detected in the indoor unit.

As described above, according to the present invention, an EIRP adjustment circuit which is necessary to meet the variable conditions affecting the circumstances of wireless channels for a satellite communication system and the communication quality, is simplified without a microcomputer and its pheripheral circuits, by using a low-frequency signal which is not affected by a communication cable. Also, by constituting the circuit as stated above, the attenuation of the IF TX signal due to the communication cable is automatically compensated. Since the presence or absence of the abnormal connection of the IFL cable can be easily identified indoors by using an LED, it is possible to detect abnormal parts quickly at the time when an abnormality occurs in the system, thereby saving time for repairing the malfunction.

What is claimed is:

1. An apparatus for controlling a radio-frequency (RF) output voltage level from an input signal and identifying continuity of an inter facility link (IFL) cable using a low frequency signal of a satellite communication system, said apparatus comprising:

a first unit comprising a modulator to modulate the input signal, a low-frequency oscillator to generate a low-frequency signal, a low-frequency variable gain amplifier to amplify the low-frequency signal, a transmitting party multiplexer to multiplex signals input from said modulator and said low-frequency variable gain amplifier, a base band & control board (BB&C) to produce a radio-frequency (RF) output voltage level control signal and a latch control signal, a latch to store the RF output voltage level control signal in accordance with said latch control signal, a digital-to-analog converter to convert a digital signal input from said latch into an analog signal and to transmit the analog signal to said low-frequency variable gain amplifier as a control signal, a receiving party demultiplexer to separate a loop-back low frequency signal and an intermediate-frequency reception (IF RX) signal from a signal received from a receiving party multiplexer, a receiver to receive said IF RX signal, a low-frequency detector to detect a level of the loop-back low frequency signal, and an indicator responsive to a signal output from said low-frequency detector so as to indicate the continuity of the IFL cable; and a second unit comprising a transmitting party demultiplexer to receive a multiplexed signal from said transmitting party multiplexer and to separate out a low-frequency signal and an intermediate-frequency transmission (IF TX) signal, a radio-frequency (RF) output voltage level controller to control an RF output voltage level of said IF TX signal in response to the separated low frequency signal, a transmit block up-converter (TBU) to up-convert an amplified IF TX signal from said RF output voltage level controller into a radio frequency, a power amplifier to amplify an RF output signal output from said TBU, an antenna to transmit and receive antenna signals, an antenna coupler to control a transmit/receive path of the antenna signals, a low noise amplifier to amplify a received signal from said antenna coupler, and a receiving party multiplexer to multiplex a low-frequency signal output from said transmitting party demultiplexer and an IF RX signal from said low noise amplifier and to transmit an output signal to said receiving party demultiplexer.

2. The apparatus as claimed in claim 1, wherein said low-frequency detector of said first indoor unit comprises a bandpass filter to receive the loop-back low frequency signal output from the receiving party demultiplexer and to filter specific bands ranging from a first predetermined frequency $f_1$ to a second predetermined frequency f2, a full-wave rectifier to rectify an output from said bandpass filter, and a comparator to compare a limit voltage with an output signal voltage from said full-wave rectifier and to display a result from the comparator to a user.

3. The system as claimed in claim 1, wherein said RF output voltage level controller includes a variable gain amplifying unit to adjust a voltage level of said IF TX signal, a voltage divider to divide a voltage level of said IF TX signal output from said variable gain amplifying unit and to output divided signals to an IF TX signal level detector and to said TBU, the IF TX signal detector detecting a level of signal output from said voltage divider and inputting a resultant value to a differential integrator, a reference level detector to detect a reference level of the low-frequency signal output from said transmitting party demultiplexer and to input a resultant value to the differential integrator, the differential integrator comparing signals input from said IF TX signal level detector and said reference level detector and outputting a resulting control signal to said variable gain amplifying unit.

4. A method of controlling a radio-frequency (RF) output voltage level and identifying continuity of an inter facility link (IFL) cable using a low frequency signal, comprising the steps of:

multiplexing an intermediate frequency (IF) signal with a low-frequency signal to produce a multiplexed signal;

transmitting the multiplexed signal from an indoor unit to an outdoor unit by a transmission (TX) cable;

separating the IF signal from the low frequency signal;

detecting a reference level, from the low-frequency signal, the low-frequency signal being level-controlled in one level out of a plurality of levels adjusting gain of a variable gain amplifier (VGA) amplifying and the separated IF signal in accordance with the reference level so as to control a level of an IF TX signal input to a transmit block upconverter amplifying an output from the transmit block upconverter in a power amplifier so as to controllably produce said RF output voltage level feeding back the separated low frequency signal from the outdoor unit to the indoor unit, detecting a level of the feedback low frequency signal at the indoor unit to determine a normal IFL cable state.

5. The method as claimed in claim 4, comprising the further steps of comparing a signal input from a reference level detector with said RF output voltage level, and controlling a level of amplification in response to a difference between the compared signals, thereby automatically compensating for attenuation of the IF TX signal in the IFL cable.

6. The method as claimed in claim 4, comprising the further steps of filtering a low frequency signal through a bandpass filter, rectifying the filtered low frequency signal through a full-wave rectifier, comparing the rectified low frequency signal in a comparator with a limit voltage indicating a normal IFL cable state to imply that there is no abnormality in the connection state of an IFL cable (TX/RX cable) if the compared low frequency signal is greater than said limit voltage.

7. The method of controlling an RF output voltage level and identifying the continuity of an inter facility link (IFL) cable using a low frequency signal, as claimed in claim 4, comprising the further step of controlling the RF output voltage level with a single transmission cable.

8. An apparatus for controlling a radio frequency signal and checking continuity of an inter-facility link, comprising:

a first unit, comprising a first unit multiplexer to multiplex an intermediate frequency signal and a low frequency signal of controllable amplitude so as to form a first multiplexed signal transmitted on the inter-facility link, a first unit demultiplexer to demultiplex a return multiplexed signal from the inter-facility link into a low frequency return signal and an intermediate frequency return signal, a low frequency detector circuit to detect the low frequency return signal so as to check the continuity of the interfacility link, and an intermediate frequency receiver to receive the intermediate frequency return signal; and a second unit, comprising a second unit demultiplexer to receive the first multiplexed signal on the inter-facility link and to separate the intermediate frequency signal and the low frequency signal, an intermediate frequency amplifier, controllable in response to a difference in magnitude between the low frequency signal and a selected portion of an intermediate frequency signal amplified by the intermediate frequency amplifier, a power amplifier to amplify the intermediate frequency signal amplified by the intermediate frequency amplifier to generate an amplified signal, an antenna, a transmission/receive switch to control transmission of the amplified signal to the antenna and transmission of a received signal from the antenna to a low noise amplifier, and a second unit multiplexer to multiplex the low frequency signal with an amplified receive signal from the low noise amplifier so as to generate the return multiplexed signal on the inter-facility link.

* * * * *